US005362268A

United States Patent [19]

Nordbeck et al.

[11] Patent Number: 5,362,268

[45] Date of Patent: Nov. 8, 1994

[54] SWIM FIN

[76] Inventors: Ellis L. Nordbeck, 5130 N. M-52, Owosso, Mich. 48867; Charles Walker, 2494 Baseline Rd., Stockbridge, Mich. 49285

[21] Appl. No.: 107,111

[22] Filed: Aug. 16, 1993

[51] Int. Cl.[5] ..... A63B 31/08; A63B 31/11

[52] U.S. Cl. ..... 441/64

[58] Field of Search ..... 441/61-64; 16/225

[56] References Cited

U.S. PATENT DOCUMENTS

| | | | |
|---|---|---|---|
| 1,061,264 | 5/1913 | Bys | 441/64 |
| 3,441,975 | 5/1969 | Shepherd | 16/225 |
| 4,310,938 | 1/1982 | Eichler | 441/64 |
| 4,828,132 | 5/1989 | Francis, Jr. et al. | 16/225 X |
| 4,954,112 | 9/1990 | Negrini | 441/64 |

FOREIGN PATENT DOCUMENTS

| | | | |
|---|---|---|---|
| 1001167 | 1/1957 | Germany | 441/61 |

*Primary Examiner*—Sherman Basinger
*Attorney, Agent, or Firm*—Learman & McCulloch

[57] ABSTRACT

The swim fins (10) each include a molded center guide (14) and a shoe portion (12). A first wing (16) is pivotally attached to one side of the center guide (14) by a hinge member (18). A second wing (20) is pivotally attached to the other side of the center guide (14) by a hinge member (22). The hinge members (18, 22) have a flexible web (50) and flanges (52, 54). One of the flanges (54) of the hinge (18) is inserted into a hinge bead retainer slot (24) in the center guide (14) and the other flange (52) is inserted into a hinge bead retainer slot (38) in the wing (16). One of the flanges (52) of the hinge (22) is inserted into a hinge bead retainer slot (26) in the center guide (14) and the other flange (54) is inserted into a hinge bead retainer slot (40) in the wing (20). Stop surfaces (42, 44, 46, 48) on the wings (16, 20) cooperate with stop surfaces (30, 32, 34, 36) on the center guide (14) to limit pivotal movement of the wings relative to the center guide.

14 Claims, 3 Drawing Sheets

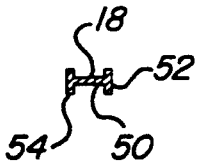
FIG-5
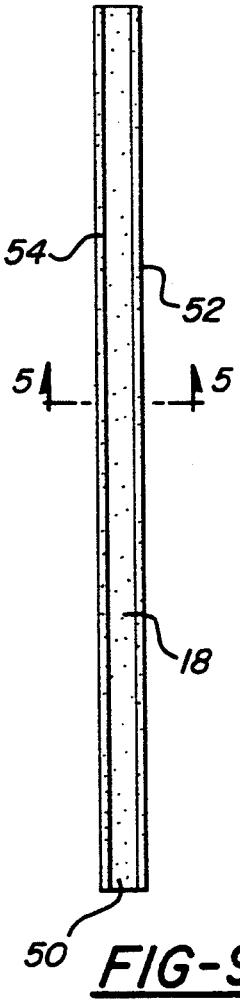
FIG-9
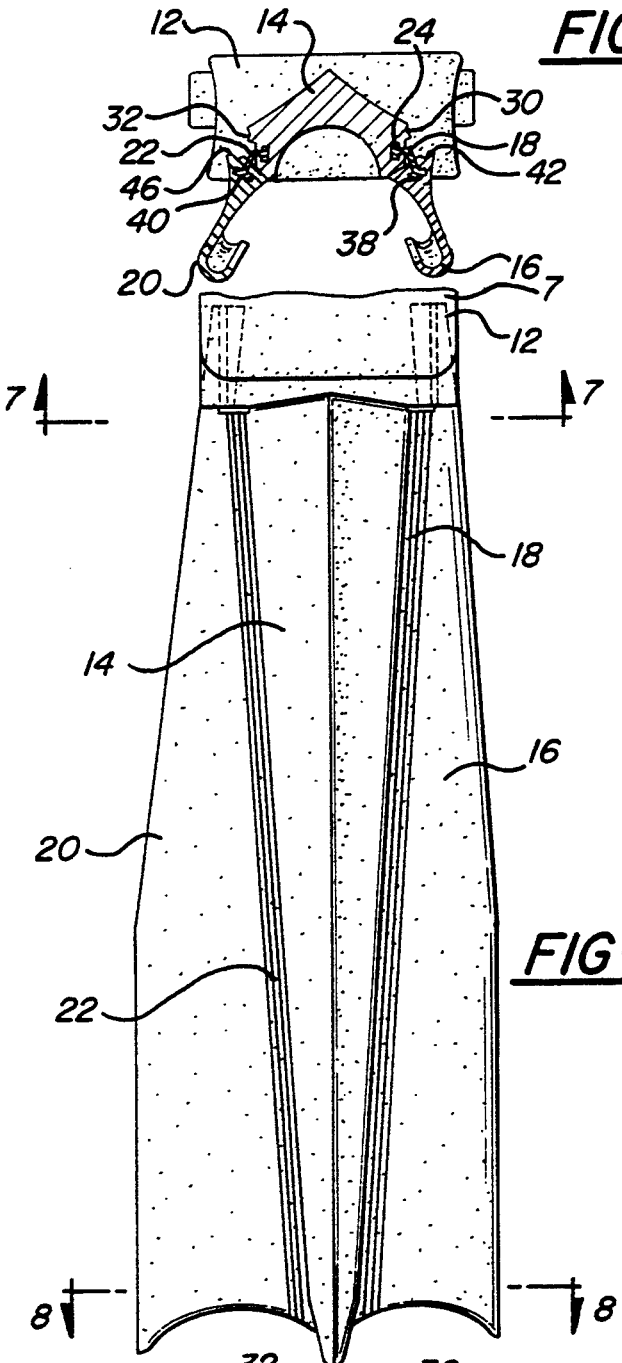
FIG-7
FIG-6
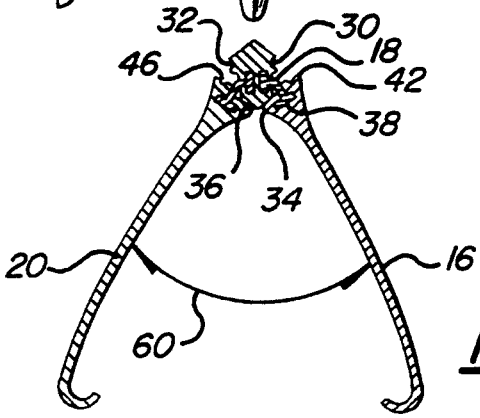
FIG-8

SWIM FIN

BACKGROUND OF THE INVENTION

The present invention relates to swim fins with reduced drag coefficients. The swim fins have a shoe, a center guide attached to the shoe, and a wing pivotally attached to each side of the center guide by hinges.

Scuba divers and some swimmers use swim fins to convert leg movement into propulsion through the water. Each swim fin generally includes a shoe with a blade attached to the front. A big blade for propulsion in water requires big and strong leg muscles. The larger the blade, the faster the scuba diver or swimmer moves, and the quicker leg fatigue sets in. Swimmers move their legs in an up and down motion, referred to as a kick, to propel themselves in the water. Most fins work in both directions of the swimmer's kick. However, a swimmer has far less muscular power for the upstroke than for the down stroke of a kick. As a result, there is less power available in the up stroke than the down stroke of each kick and less propulsion is obtained from the up stroke. Unfortunately, the exertion or work on the part of the scuba diver or swimmer is not substantially reduced during the up stroke when using two stage swim fins that provide propulsion in both directions of a swimmer's kick. Swim fins have been proposed which provide single stage propulsion in that they provide maximum propulsion during the down stroke and minimum propulsion during the up stroke. Such single stage swim fins reduce leg fatigue. The single stage swim fins that have been used in the past have had poor durability and high drag. The high drag has resulted in decreased speed and quicker leg fatigue.

SUMMARY OF THE INVENTION

An object of the invention is to provide swim fins with single stage propulsion and minimal hydrodynamic drag to minimize leg muscle exertion, reduce oxygen consumption, and enable increased speed through the water.

Another object of the invention is to provide swim fins with single stage propulsion and improved durability.

The swim fins each have a center guide or carrier base attached to a shoe. The center guide is a strong molded polymer member with a hinge bead retainer slot on each side. The hinge bead retainer slot extends substantially the length of the center guide. The upper surface of the center guide is contoured to cut through water during up strokes. Two wings with hinge bead retainer slots are attached to the sides of the center guide by hinges. Each hinge is a thermoplastic polymer member with a flexible web and a relatively hard bead integral with each side of the flexible web. One bead of each hinge is inserted into the bead retainer slot in the center guide and the other bead of each hinge is inserted into the hinge bead retainer slot in one of the wings. The hinge extends the length of the wing which it attaches to the center guide. The hinges allow the two wings to fold down during an up stroke and cooperate with the contoured upper surface of the center guide to minimize hydrodynamic drag during an upstroke. Stop surfaces on the center guide cooperate with stop surfaces on the wings to limit pivotal movement of the wings relative to the center guide and to align the wings relative to the center guide.

The foregoing and other objects, features, and advantages of the present invention will become apparent in light of the following detailed description of an exemplary embodiment thereof, as illustrated in the accompanying drawing.

BRIEF DESCRIPTION OF THE DRAWING

FIG. 5 is an end view of the hinge;

FIG. 6 is a plan view of the swim fin with the wings in a folded position for an upstroke and with a portion of the shoe broken away;

FIG. 7 is a sectional view taken along line 7—7 in FIG. 6;

FIG. 8 is a sectional view taken along line 8—8 in FIG. 6; and

FIG. 9 is a side view of the hinge.

DETAILED DESCRIPTION OF THE PREFERRED EMBODIMENT

Figure 1:
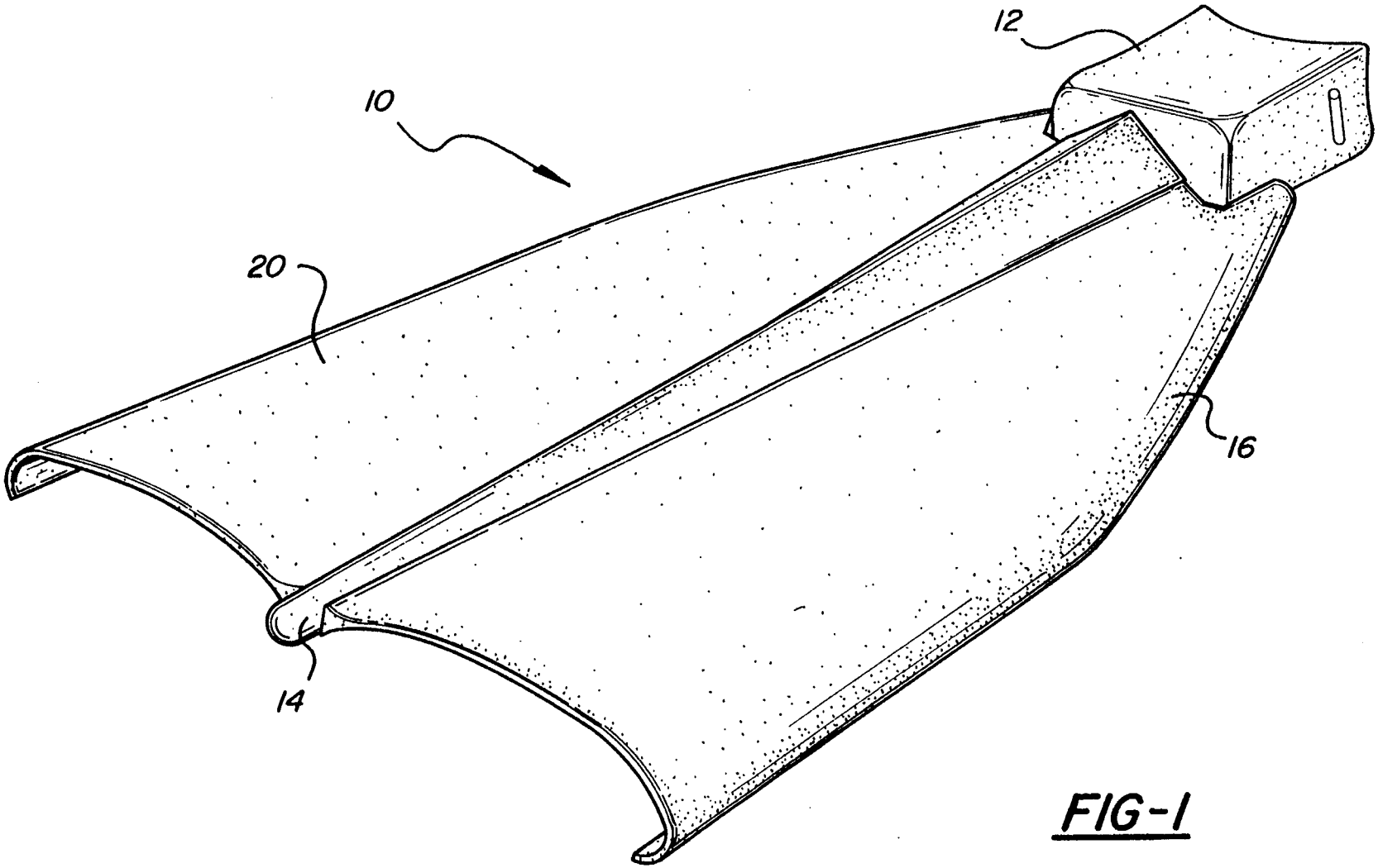
FIG. 1 is a perspective view of the swim fin with the wings in position for a down stroke.
Figure 3:
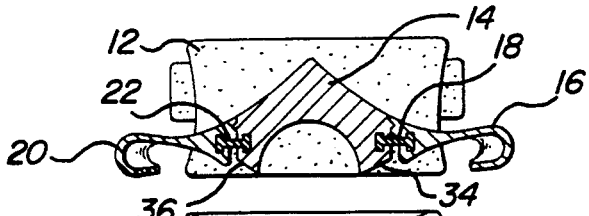
FIG. 3 is a sectional view taken along line 3—3 in FIG. 2.
Figure 2:
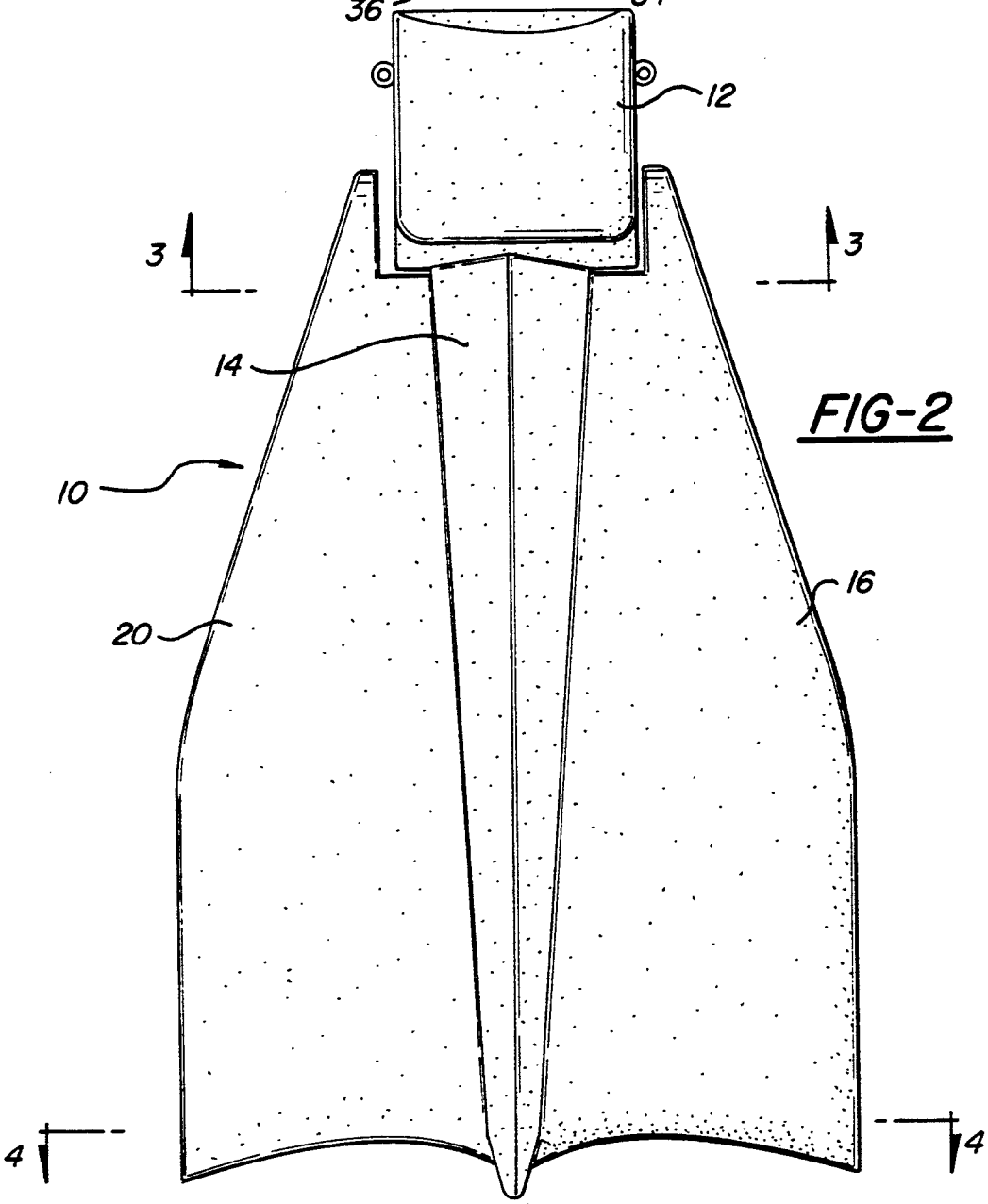
FIG. 2 is a plan view of the swim fin with the wings in position for a down stroke.

The swim fin 10 includes a shoe portion 12 for attaching the swim fin to the foot of a scuba diver or a swimmer. A molded center guide 14 is attached to the shoe portion 12 of the swim fin 10. A wing 16, shown on the right-hand side in FIG. 2, is attached to one side of the center guide 14 by a first hinge member 18. A wing 20, shown on the left-hand side in FIG. 2, is attached to the other side of the center guide 14 by a second hinge member 22. The hinge member 18 is identical to the hinge member 22. The flanges 52 and 54 of the hinge 18 serve as beads for attaching the hinge member to the center guide 14 and to a wing 16 or 20.

The molded center guide 14 is molded from a polymer material. A right side hinge bead retainer slot 24 is formed in one side of the center guide 14. A left side hinge bead retainer slot 26 is formed in the other side of the center guide 14. The two bead retainer slots 24 and 26 extend substantially the full length of the center guide 14. Upper wing stop surfaces 30 and 32 are formed on the sides of the center guide 14 above the hinge bead retainer slots 24 and 26 to limit upward movement of the wings 14 and 20 during a down stroke of the swim fin. Lower wing stop surfaces 34 and 36 are formed on the sides of the center guide 14 below the bead retainer slots 24 and 26 to limit downward movement of the wings 16 and 20 during an upstroke of the swim fins 10. The shoe portion 12 of the swim fin 10 is preferably integral with the center guide 14 and is formed at the same time the center guide is molded.

The wings 16 and 20 of the swim fin 10 are made from a polymer. A hinge bead retainer slot 38 is formed in the wing 16 at the time the wing is formed. A hinge bead retainer slot 40 is formed in the wing 20 at the same time the wing is formed. The hinge bead retainer slots 38 and 40 extend the length of the wings 16 and 20. The wing 16 has an upper stop surface 42 above the hinge bead retainer slot 38. The wing 16 also has a lower stop surface 44 below the wing bead retainer slot 38. The wing 20 has an upper stop surface 46 above the wing bead retainer slot 40. The wing 20 also has a lower stop surface 48 below the hinge bead retainer slot 40.

The first hinge member 18 as shown in FIGS. 5 and 9 has the shape of an I-beam. The second hinge member 22 also has the shape of an I-beam. Both hinge members 18 and 22, as shown in FIGS. 5 and 9, have a mid-part or web 50 and a pair of flanges 52 and 54. The flanges 52 and 54 function as retainer beads. The hinge 18 is a dual durometer polymer. A durometer test is a hardness test. The term dual durometer means that the hinge has two hardnesses. The web 50 is a supple material that can flex, is relatively soft, and is strong. The flanges 52 and 54 have a higher hardness, are less flexible, and are also strong. The web can be a material such as polypropylene or polyethylene. The flanges 52 and 54 have an increased hardness. The flanges 52 and 54 can be a harder polymer material such as a polymer sold by Monsanto under the mark (SANTOPRENE). The web 50 can be bonded or heat welded to the flanges 52 and 54. The hinge 18 can also be injection molded using two different polymers.

The wing 16 of the swim fin 10 is attached to the center guide 14 by inserting one flange 54 of a hinge member 18 in the right side hinge bead retainer slot 24 formed in one side of the center guide 14 and inserting the other flange 52 in the hinge bead retainer slot 38 in the wing 16. The wing 20 of the swim fin 10 is attached to the center guide 14 by inserting the flange 52 of the hinge member 22 in the left side hinge bead retainer slot 26 formed in the other side of the center guide 14 and inserting the flange 54 in the hinge bead retainer slot 40 formed in the wing 20.

During use of the swim fins described above a scuba diver or swimmer raises his feet and the swim fins 10 during a recovery or up stroke. The movement of each swim fin 10 upwardly in the water pivots the wing 16 downwardly relative to the center guide 14 until the lower stop surface 44 on the wing contacts the lower wing stop surface 34 on the center guide. The other wing 20 pivots downwardly relative to the center guide 14, at the same time the wing 16 pivots downward, until the lower stop surface 48 on the wing contacts the lower wing stop surface 36 on the center guide and both wings are in the folded position shown in FIG. 8. The webs 50 of the first hinge member 18 and the second hinge member 22 bend along their entire length to allow the wings 16 and 20 to fold down relative to the center guide 14. In the folded position shown in FIG. 8, the swim fin 10 assumes an inverted V-shape in which resistance to movement through the water is minimized and each fin cuts through the water. The recovery or up stroke, due to the hydrodynamic shape of the swim fins 10, requires minimal effort on the part of a scuba diver or swimmer, thereby minimizing leg fatigue and oxygen demand. At the start of a down stroke or power stroke, the wings 16 and 20 fold up and the webs 50 of the first hinge member 18 and the second hinge member 22 straighten. The wings 16 and 20 fold up until the upper stop surface 42 on the wing 16 on the right side contacts the upper wing stop surface 30 on the center guide 14, the upper stop surface 46 on the wing 20 on the left side contacts the upper wing stop surface 32 on the center guide and the wings are in the position shown in FIG. 4. In this position, with the wings 16 and 20 in a substantially common plane, a continued down stroke will propel a scuba diver or swimmer through the water.

Figure 4:
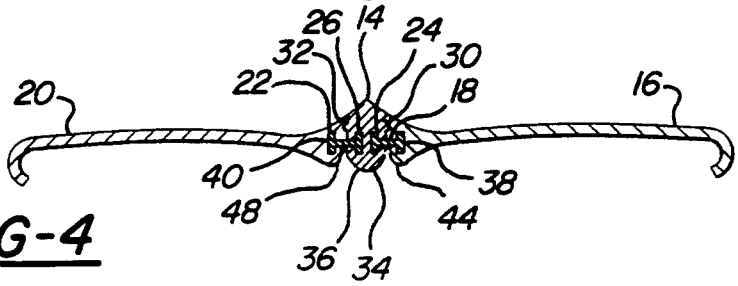
FIG. 4 is a sectional view taken along line 4—4 in FIG. 2.

Each wing 16 or 20 pivots through an angle of less than 90° as it moves from the position shown in FIG. 4 to the position shown in FIG. 8. The movement is less than 90° by half the angle 60 shown in FIG. 8.

Preferred embodiments of the invention have been described in detail but are examples only and the invention is not restricted thereto. It will be easily understood by those skilled in the art that modifications and variations can easily be made within the scope of this invention.

We claim:

1. A swim fin including an elongated center guide with at least two sides, a first bead slot in one of the sides extending substantially the length of said center guide and a second bead slot in the other said side extending substantially the length of said center guide;

a shoe attached to said center guide for attaching said center guide to the foot of a diver;

a first wing with an integral bead slot;

a second wing with an integral bead slot;

a first hinge for pivotally connecting the first wing to the elongated center guide, with a pair of beads interconnected to each other by a flexible web and wherein one of the beads is retained in said first bead slot in the center guide and the other bead is retained in the integral bead slot in the first wing;

a second hinge, for pivotally connecting the second wing to the elongated center guide, with a pair of beads interconnected to each other by a flexible web and wherein one of the beads is retained in said second bead slot in the center guide and the other bead is retained in the integral bead slot in the second wing;

a first pair of stop surfaces on said elongated center guide and a pair of stop surfaces on said first wing that contact said first pair of stop surfaces to limit pivotal movement of the first wing relative to said elongated center guide in two directions; and a second pair of stop surfaces on said elongated center guide and a pair of stop surfaces on said second wing that contact said second pair of stop surfaces to limit pivotal movement of said second wing relative to said elongated center guide in two directions.

2. A swim fin as set forth in claim 1 wherein the first wing and the second wing are a molded polymer.

3. A swim fin as set forth in claim 1 wherein the first pair of stop surfaces on said elongated center guide includes one stop surface positioned to one side of the first bead slot and another stop surface positioned to the other side of the first bead slot; and said second pair of stop surfaces on said elongated center guide including one stop surface positioned to one side of the second bead slot and another stop surface positioned to the other side of the second bead slot.

4. A swim fin as set forth in claim 3 wherein the first pair of stop surfaces on said elongated center guide extends substantially the length of the first bead slot and the second pair of stop surfaces on said elongated center guide extends substantially the length of the second bead slot.

5. A swim fin as set forth in claim 4 wherein the pair of stop surfaces on the first wing extend substantially the length of the first hinge and the pair of stop surfaces on the second wing extend substantially the length of the second hinge.

6. A swim fin as set forth in claim 1 wherein the flexible web of the first hinge has a generally rectangular cross section in a plane perpendicular to a long axis of the first hinge and the flexible web of the second hinge has a generally rectangular cross section in a plane perpendicular to the long axis of the second hinge.

7. A swim fin as set forth in claim 1 wherein the first and second hinges are polymer members and the beads of the first and second hinges are harder than the webs of the first and second hinges.

8. A swim fin including an elongated center guide with at least two sides, a first bead slot in one of said sides extending substantially the length of said center guide and a second bead slot in the other side extending substantially the length of said center guide;

a shoe attached to said center guide for attaching said center guide to the foot of a diver;

a first wing of molded polymer with an integral bead slot;

a second wing of molded polymer with an integral bead slot;

a first hinge for pivotally connecting the first wing to the elongated center guide, with a pair of beads interconnected to each other by a flexible web and wherein one of the beads is retained in said first bead slot in the center guide and the other bead is retained in the integral bead slot in the first wing;

a second hinge for pivotally connecting the second wing to the elongated center guide, with a pair of beads interconnected to each other by a flexible web and wherein one of the beads is retained in said second bead slot in the center guide and the other bead is retained in the integral bead slot in the second wing;

a first pair of stop surfaces on said elongated center guide including one stop surface which is positioned to one side of the first bead slot and another stop surface which is positioned to the other side of the first bead slot;

a pair of stop surfaces on said first wing that contact said first pair of stop surfaces to limit pivotal movement of said first wing relative to said elongated center guide in two directions; and a second pair of stop surfaces on said elongated center guide including one stop surface which is positioned to one side of the second bead slot and another stop surface which is positioned to the other side of the second bead slot and a pair of stop surfaces on said second wing that contact said second pair of stop surfaces to limit pivotal movement of said second wing relative to said elongated center guide and wherein the first pair of stop surfaces on said elongated center guide extend substantially the length of the first bead slot, the second pair of stop surfaces on said elongated center guide extend substantially the length of the second bead slot, the pair of stop surfaces on the first wing extend substantially the length of the first hinge and the pair of stop surfaces on the second wing extend substantially the length of the second hinge.

9. A swim fin as set forth in claim 8 wherein the flexible web of the first hinge has a generally rectangular cross section in a plane perpendicular to a long axis of the first hinge and the flexible web of the second hinge has a generally rectangular cross section in a plane perpendicular to the long axis of the second hinge.

10. A swim fin as set forth in claim 8 wherein the first and second hinges are polymer members and the beads of the first and second hinges are harder than the webs of the first and second hinges.

11. A swim fin including an elongated center guide with at least two sides, a first bead slot in one of said sides extending substantially the length of the center guide and a second bead slot in the other said side extending substantially the length of said center guide;

a shoe attached to the center guide for attaching said center guide to the foot of a diver;

a first wing with an integral bead slot;

a second wing with an integral bead slot;

a first hinge for pivotally connecting the first wing to the elongated center guide, with a pair of beads interconnected to each other by a flexible web and wherein one of the beads is retained in said first bead slot in the elongated center guide, the other bead is retained in the integral bead slot in the first wing and the flexible web closes a gap between the elongated center guide and the first wing during an up stroke of said swim fin; and a second hinge, for pivotally connecting the second wing to the elongated center guide, with a pair of beads interconnected to each other by a flexible web and wherein one of the beads is retained in said second bead slot in the elongated center guide, the other bead is retained in the integral bead slot in the second wing and the flexible web closes a gap between the elongated center guide and the second wing during an up stroke of said swim fin.

12. A swim fin as set forth in claim 11 wherein the first and second wings are a molded polymer.

13. A swim fin as set forth in claim 11 wherein the first and second hinges each have a long axis extending their length that is parallel to their beads and wherein the flexible web that interconnects the beads to each hinge has a substantially uniform thickness in a plane perpendicular to said long axis.

14. A swim fin as set forth in claim 11 wherein each of said hinges is a polymer material with beads that are harder than the flexible web.

* * * * *